US006283004B1

(12) United States Patent
Tseng

(10) Patent No.: US 6,283,004 B1
(45) Date of Patent: Sep. 4, 2001

(54) SHOELACE

(75) Inventor: Tony Tseng, Chang Hua Hsien (TW)

(73) Assignee: Taiwan Paiho Limited, Chang Hua Hsien (TW)

( * ) Notice: Subject to any disclaimer, the term of this patent is extended or adjusted under 35 U.S.C. 154(b) by 0 days.

(21) Appl. No.: 09/759,416

(22) Filed: Jan. 12, 2001

(51) Int. Cl.[7] ..... D04C 1/00
(52) U.S. Cl. ..... 87/6; 87/9; 57/230
(58) Field of Search ..... 87/3, 4, 6, 9, 11, 87/13; 24/712, 713; 57/206, 230

(56) References Cited

U.S. PATENT DOCUMENTS 2,141,801 * 12/1938 Taft ..... 24/713
2,477,151 * 7/1949 Stapleton ..... 24/713
2,887,005 * 5/1959 Fromm ..... 87/6
3,059,518 * 10/1962 Nelson ..... 24/715.4
3,078,755 * 2/1963 Chance, Jr. ..... 87/9
3,110,945 * 11/1963 Howe, Jr. ..... 24/713
4,754,685 * 7/1988 Kite et al. ..... 87/9
4,858,282 * 8/1989 DuPont, Jr. ..... 24/140
4,930,196 * 6/1990 Laurin ..... 24/715.3
5,029,372 * 7/1991 Brinson ..... 87/9
5,272,796 * 12/1993 Nichols ..... 87/9
5,673,546 * 10/1997 Abraham et al. ..... 87/3
5,809,861 * 9/1998 Hummel ..... 87/6
5,920,970 * 7/1999 Coblentz ..... 87/9
5,934,168 * 8/1999 Feichtinger et al. ..... 87/6

* cited by examiner

*Primary Examiner*—John J. Calvert
*Assistant Examiner*—Gary L. Welch
(74) *Attorney, Agent, or Firm*—Pro-Techtor International Services

(57) ABSTRACT

A shoelace having a center core, and a braided fabric formed by weaving together several base threads and several stopper threads and covered on the periphery of the center core, the stopper threads having a greater diameter than the base threads and forming a spiral protruded portion in the braided fabric.

2 Claims, 4 Drawing Sheets

SHOELACE

BACKGROUND OF THE INVENTION

The present invention relates to a shoelace and, more specifically, to such a shoelace that provides a high friction resistance against slipping when installed in the shoe and tied up.

Regular cylindrical shoelaces are commonly comprised of a center core and a tube of braided fabric covered on the periphery of the center core. Weaving together weft threads and warp threads of equal number and size forms the braided fabric. Because the number and size of the weft threads are same as the warp threads, the outer wall of the tube of braided fabric is relatively smooth. When the two distal ends of this structure of shoelace are tied up, less friction resistance is produced between the two distal ends of the shoelace, and the ends of the shoelace tend to loosen.

SUMMARY OF THE INVENTION

It is the main object of the present invention to provide a shoelace, which has a protruded portion spirally extended along the length for positive positioning after installation in the shoe. According to the present invention, weaving together base threads and stopper threads forms the tube of braided fabric of the shoelace around the center core. The number and diameter of the stopper threads are greater than the base threads so that a protruded portion is formed in the tube of braided fabric and extended in a spiral manner after the formation of the braided fabric.

DETAILED DESCRIPTION OF THE PREFERRED EMBODIMENT

Figure 1:
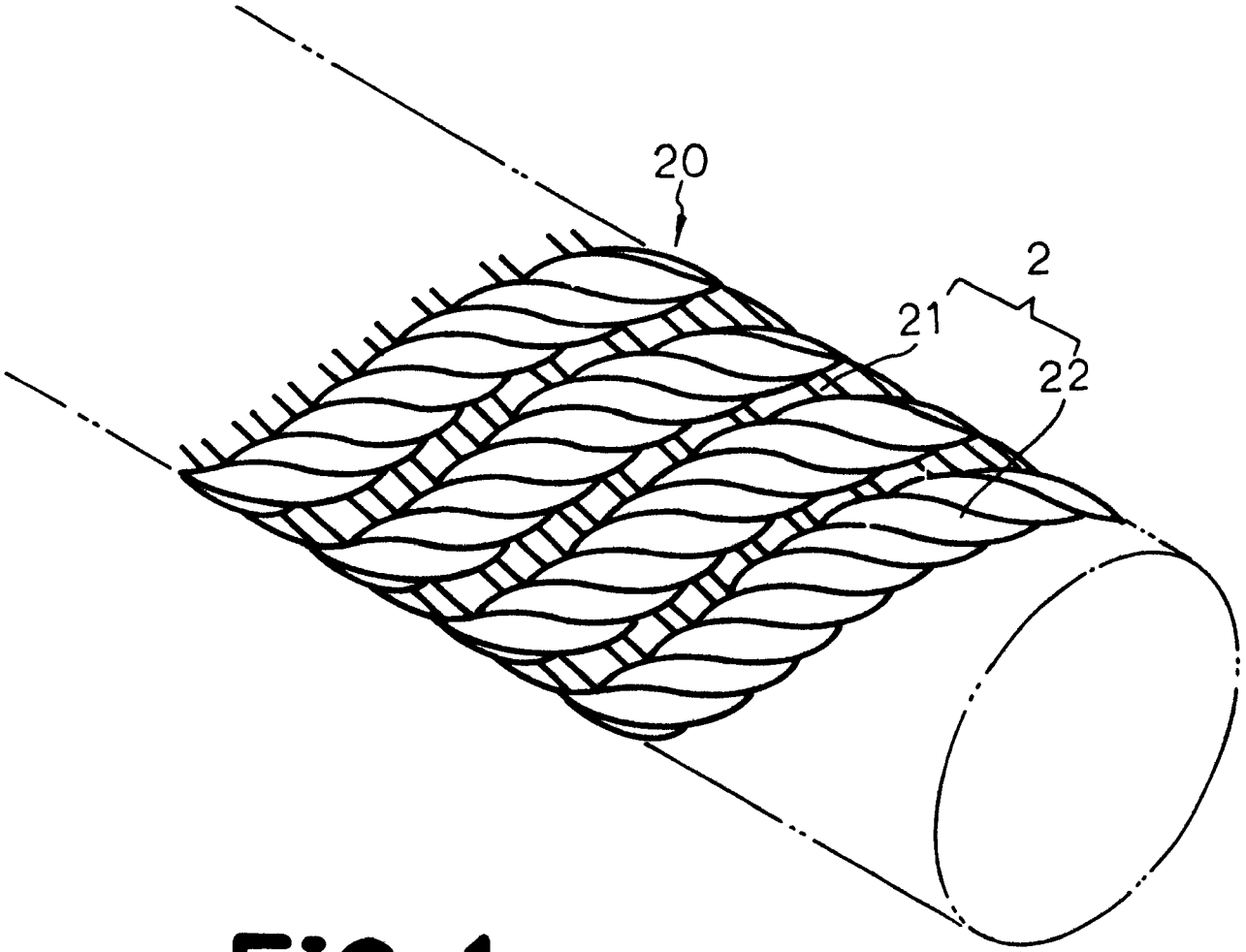
FIG. 1 is a perspective view of a part of a shoelace according to the present invention.
Figure 2:
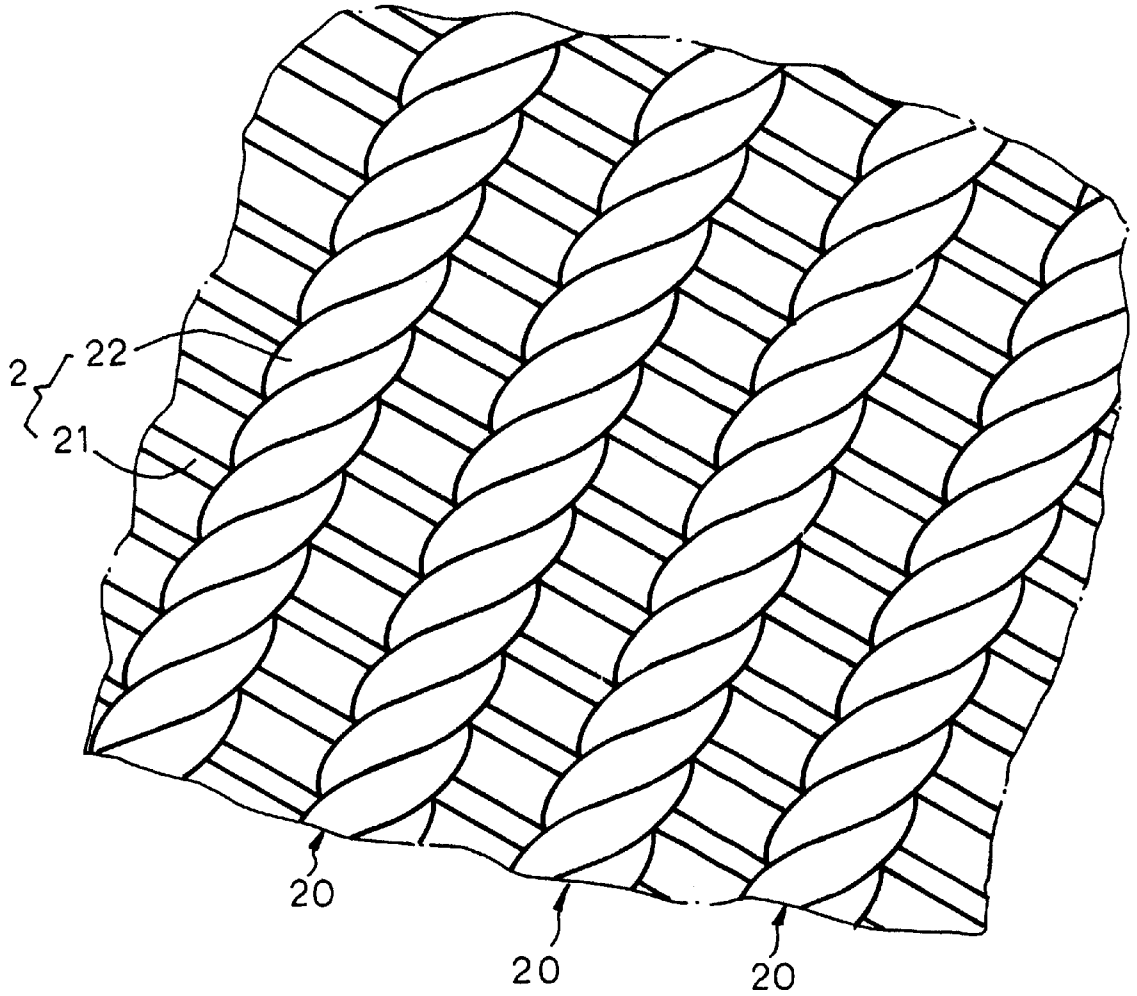
FIG. 2 is a plain view of a part of the shoelace according to the present invention.

Referring to FIGS. from 1 through 3, a shoelace in accordance with the present invention is shown comprising a center core 1, and a braided fabric 2 covered on the periphery of the center core 1. The braided fabric 2 is formed by weaving together several base threads 21 and stopper threads 22. The number of the stopper threads 22 is greater than the number of the base threads 21.

Figure 4:
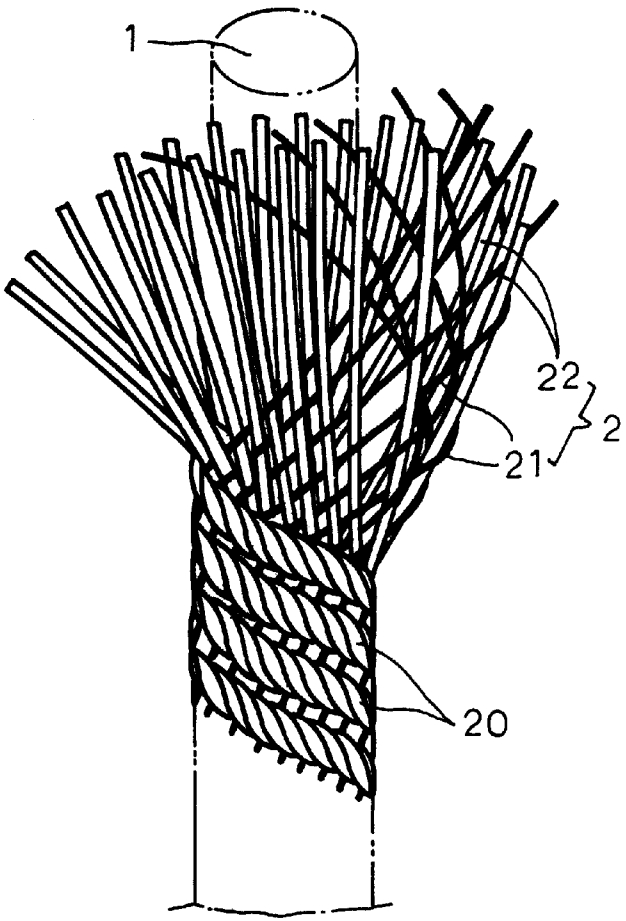
FIG. 4 illustrates the weaving of the base threads with the stopper threads around the center core according to the present invention.

Referring to FIG. 4 and FIGS. from 1 through 3 again, weaving together the base threads 21 and the stopper threads 22 forms the braided fabric 2. Because the stopper threads 22 are relatively thicker than the base threads 21, a protruded portion 20 is formed in the braided fabric 2 and extended spirally around the center core 1 after the formation of the braided fabric 2. Because the diameter of the base threads 21 is smaller than the stopper threads 22, the base threads 21 are merged in the protruded portion 20 of the stopper threads 22. After the shoelace has been installed in the shoe and the ends of the shoelace have been tied up, the stopper threads 22 of one end of the shoelace are stopped against the stopper threads 22 of the other end of the shoelace, preventing a slip.

Figure 3:
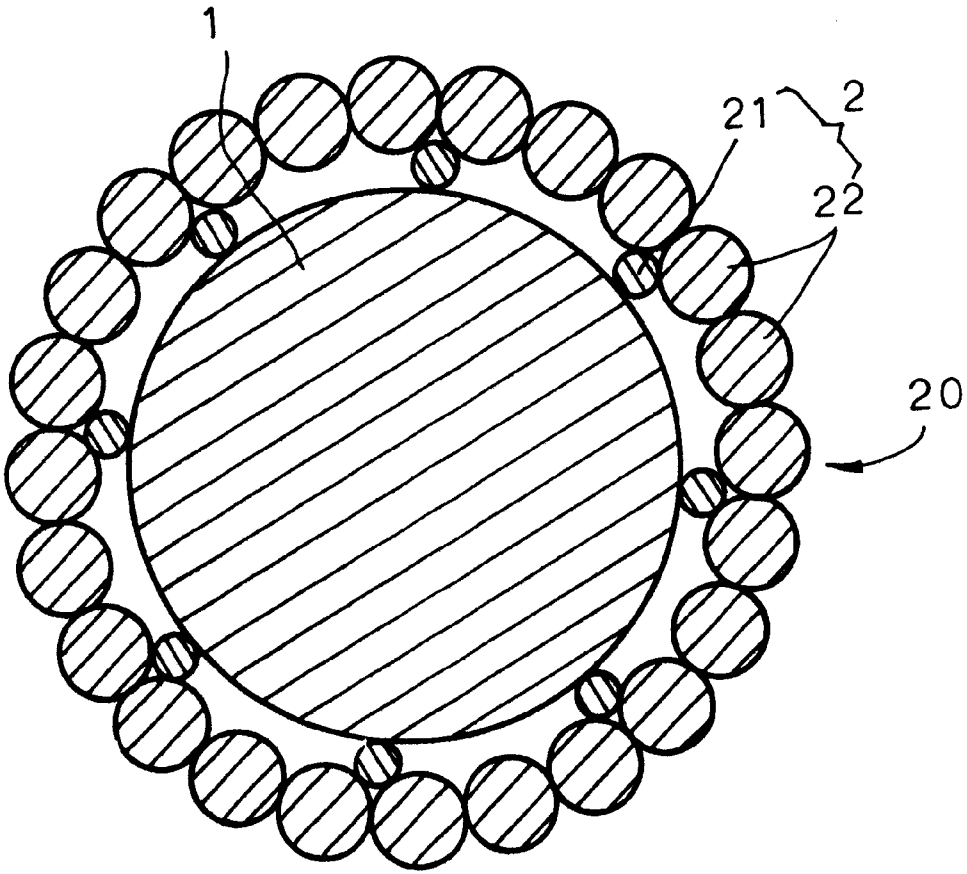
FIG. 3 is a cross-sectional view of the shoelace according to the present invention.

Referring to FIGS. 3 and 4 again, according to the present preferred embodiment of the present invention, the number of the base threads 21 is 8 pieces, and the number of the stopper threads 22 is 24.

It is to be understood that the drawings are designed for purposes of illustration only, and are not intended for use as a definition of the limits and scope of the invention disclosed.

What the invention claimed is:

1. A shoelace comprising:

a unitary center core, and a woven fabric covering said center core; wherein said woven fabric comprises a plurality of base threads and a plurality of stopper threads woven together, said stopper threads have a diameter larger than a diameter of said base threads, and said base threads and a plurality of stopper threads being woven together in a pattern such that longitudinal axes of said base threads are perpendicular to longitudinal axes of said stopper threads; such that an exterior surface of said stopper threads protrudes above an exterior surface of said base threads to form a protruding spiral pattern around said center core.

2. The shoelace of claim 1, wherein:

a ratio of a number of said base threads to a number of said stopper threads is 8:24.

* * * * *